United States Patent [19]

Ruf

[11] 4,392,797

[45] Jul. 12, 1983

[54] DEVICE FOR LUBRICATING A ROTARY PISTON AIR PUMP

[75] Inventor: Max Ruf, Neckarsulm, Fed. Rep. of Germany

[73] Assignee: Audi NSU Auto Union Aktiengesellschaft, Neckarsulm, Fed. Rep. of Germany

[21] Appl. No.: 197,815

[22] Filed: Oct. 17, 1980

[30] Foreign Application Priority Data

Oct. 23, 1979 [DE] Fed. Rep. of Germany ..... 2942696

[51] Int. Cl.[3] ..... F04C 18/10; F04C 29/02

[52] U.S. Cl. ..... 418/91; 418/99; 418/167; 418/186

[58] Field of Search ..... 418/91, 97–100, 418/167, 171, 186, 187

[56] References Cited

U.S. PATENT DOCUMENTS 2,140,966 12/1938 Nichols ..... 418/171

FOREIGN PATENT DOCUMENTS 551360 5/1932 Fed. Rep. of Germany ..... 418/98

*Primary Examiner*—John J. Vrablik

*Attorney, Agent, or Firm*—Kane, Dalsimer, Kane, Sullivan and Kurucz

[57] ABSTRACT

A device for lubricating a rotary piston air pump driven by an engine penetrated by lubricating oil return conduits. The device includes a rotary housing including a casing and two side walls and rotatably mounted on a stationary axle having an eccentric thereon. The axle penetrates the housing perpendicular with respect to the side walls and receives on its eccentric a rotating piston, which is in camming engagement with the casing and limits volume changing operating chambers. The surface of the eccentric on which the piston is mounted is provided with a recess in communication with a suction conduit and a recess in communication with a discharge conduit. The piston has control openings for successively communicating the recesses with the operating chambers during rotary movement of the piston. An oil bore discharges on the surface of the eccentric on which the piston is mounted in a rotating direction of the piston about 15 degrees–30 degrees after the position with the least distance to the center of the axle and laterally offset with respect to the control openings of the piston, whereby the oil bore communicates with an oil conduit of the engine.

4 Claims, 2 Drawing Figures

DEVICE FOR LUBRICATING A ROTARY PISTON AIR PUMP

BACKGROUND OF THE INVENTION

The invention relates to a device for lubricating a rotary piston air pump. The pump is the type which is driven by an engine which is penetrated by lubricating oil return conduits. The device includes a rotary housing which is composed of a casing and two side walls and is rotatably mounted on a stationary axial having an eccentric thereon. The axle penetrates the housing perpendicularly with respect to the side walls and receives on its eccentric a rotating piston which is in camming engagement with the casing on limits volume changing operating chambers. The surface or mounting face of the eccentric on which the piston is positioned is provided with a recess communicating with a suction conduit and a recess communicating with a discharge conduit. Control openings in the piston communicate to these recesses successively with the operating chambers during the rotary movement.

German Petty Pat. No. 71 26 734 discloses a rotary piston air pump wherein the piston and/or the casing consists of a plastic material with a low friction value or is provided with self lubricating characteristics for reducing the friction generated within the pump. With such a measure the sliding characteristics may be improved, the wear reduced and the life span of the pump increased, but the problem of the generally insufficient sealing between the piston and the inner walls of the case cannot be eliminated, which results in an insufficient pump output, particularly at a lower speed.

SUMMARY OF THE INVENTION

It is therefore an object of the invention to provide a rotary piston air pump of the type described above, which has good sliding characteristics and assures a sufficient output throughout the total operating range. This objective is achieved by having an oil bore discharge on the surface of the eccentric on which the piston is mounted in the rotating direction of the piston by about 15 degrees–30 degrees after the position with the least distance to the center of the axle and laterally offset with respect to the control openings of the piston, and oil bore being in communication with an oil conduit of the engine.

Lubricating oil can be automatically drawn in through the suggested oil bore which discharges in close proximity of the suction conduit in an area wherein a vacuum prevails during the operation of the pump. In this manner, the lubricating oil flows through the eccentric onto the inner face of the housing and the side walls in which the piston slides. Thus, a sufficient lubrication of the sliding parts of the pump is achieved. Therefore, there is no need to use materials with good sliding characteristics. The specific advantage of this solution to the problem consists in that a lubricating oil which distributes on the inner face of the housing and the side walls adheres thereto, so that it has a sealing effect between the piston and the side walls and the housing, respectively. The obtained seal permits and assures the output at each speed range. Excess lubricating oil is discharged from the operating chamber through the discharge conduit and can be trapped in a known manner.

The supply of the lubricating oil to the oil bore is obtained by communicating the oil conduit with the lubricating oil return conduit of the engine by means of a piece of pipe which extends into the lubricating oil return conduit and is provided with an upper open oil trapping pocket. When the oil trapping pocket is disposed higher than the discharge opening of the oil bore and when the oil conduit has a sloping position, a certain amount of lubricating oil remains in the oil conduit which is immediately available as a lubricating and sealing means when the pump is restarted after being in a rest position.

In a device where the rotating piston air pump is excessively used for generating a vacuum pressure, the discharge conduit may discharge into the lubricating oil return conduit. With this embodiment, the excess lubricating oil can be returned to the engine in a simple manner without any additional devices.

BRIEF DESCRIPTION OF THE DRAWINGS

One embodiment of the invention will now be described in more detail in conjunction with the drawings which show.

DETAILED DESCRIPTION

Figure 1:
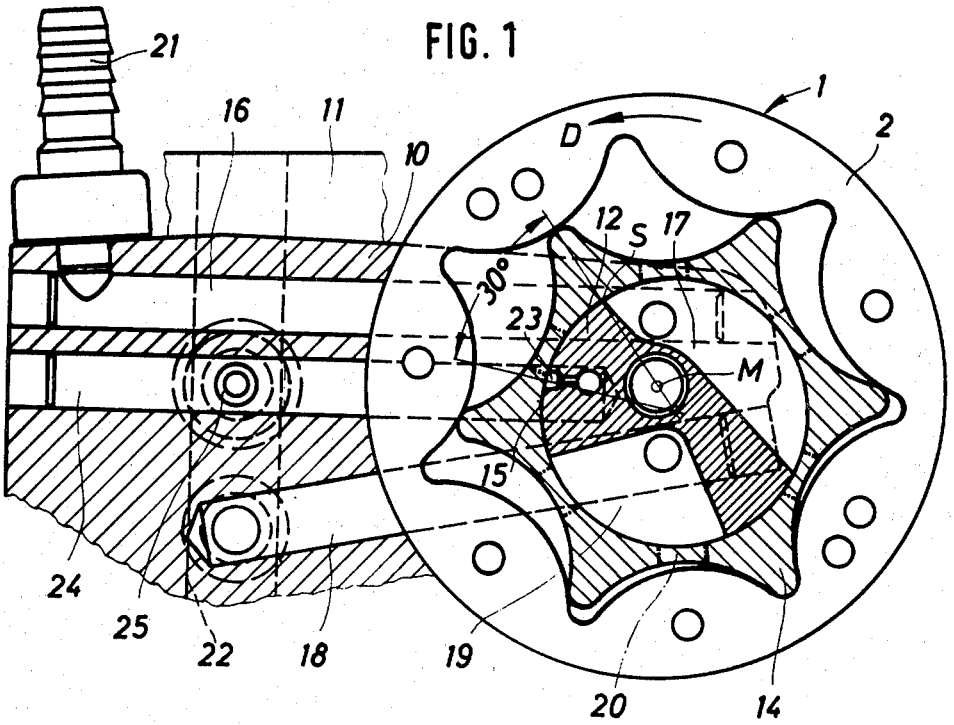
FIG. 1 is a partially sectional view of a rotary piston air pump including a drive pulley and which is mounted on an engine by means of a support element.
Figure 2:
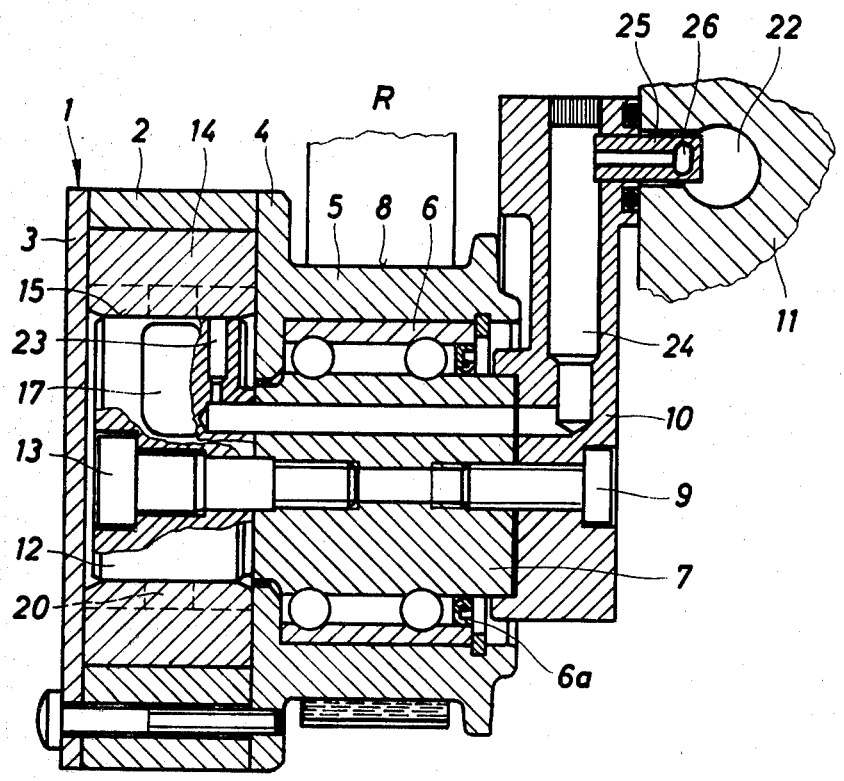
FIG. 2 is a cross-sectional view thereof through the rotary piston air pump of FIG. 1.

The rotary piston air pump of FIGS. 1 and 2 is intended for use in generating a vacuum pressure for an engine and is formed by an inner axial rotary piston with a transmission ratio of 7:6 in camming engagement. The housing 1 of this rotary piston air pump is essentially composed of a housing casing 2 and two parallel side walls 3 and 4. In FIG. 1, the side wall 3 has been removed. Laterally on side wall 4 is a drive pulley 5 of a pulley drive which receives a bearing 6 which is sealed to the outside by a sealing ring 6*a*. Housing 1 is rotatably mounted on the bearing on a stationary axle 7. The belt R moves in the direction of the arrow in FIG. 1 on the outer circumference 8 of the pulley 5. For example, this can be accomplished with the use of an auxiliary unit-drive pulley of the engine and, in this manner, housing 1 is rotated. Axle 7 is mounted with its one end on a support element 10 by a means of screw 9. The support element is coupled with the partially shown engine 11. An eccentric 12 is mounted at the other end of axle 7. For example, this mounting on axle 7 can be accomplished with a screw 13. A piston 14 is rotatably mounted on the eccentric 12. The piston is in gear meshed engagement with casing 2 and limits volume changing chambers. The surface or bearing face 15 of eccentric 12 on which piston 14 is mounted is provided with a recess 17, which is coupled to and in communication with a suction conduit 16 and recess 19 which is coupled to and in communication with a discharge conduit 18. Recesses 17 and 19 are coupled and communicate successively with the operating chambers during rotation of piston 14 by way of control openings 20 in the gear-like recesses of piston 14. The suction conduit 16 which runs through axle 7 and support element 10 is coupled to and communicates with the means of the engine which is actuated by the vacuum pressure (not shown) by means of sleeve 21. Discharge conduit 18 also runs through axle 7 and the support element 10 and discharges in a lubricating return conduit 22 of engine 11, into which the air pump silently discharges.

The device for lubricating the rotary piston air pump is formed by an oil bore 23 discharging on the bearing face 15 of the eccentric in a rotating direction of the piston 14 after recess 17 and, for example, 30 degrees after the location S of the least distance of the eccentric 12 to the center M of axle 7 and laterally offset with respect to the control openings 20 of piston 14 and recesses 17 and 19. This oil bore 23 is coupled to the lubricating oil return conduit 22 through oil conduit 24 which runs through the axle 7 and between the suction conduit 16 and the discharge conduit 18 in support element 10. For this purpose, oil conduit 24 is provided with a piece of pipe 25 which extends into the lubricating oil return conduit 22 with an upwardly open oil trap pocket 26.

When the housing 1 rotates in the direction of arrow D a pumping operation is carried out, wherein a vacuum pressure is generated for the coupled and communicating means in suction conduit 16, control openings 20 and recesses 17, while air is discharged through control openings 20 and recess 19 and through discharge conduit 18. The pressure conditions in the operating chambers are such that at the location at which the oil bore 23 discharges on the eccentric 12 a weakened vacuum pressure is formed which is weaker by about 0,1 to 0,2 bar. Since the oil conduit 24 slopes from the piece of pipe 25 in the direction of the oil bore 23, lubrication oil which enters the oil conduit 24 from the lubricating oil return conduit 22 is sucked or drawn off by means of the oil trap pocket 26 and the oil bore 23. In this manner, lubricating oil is automatically distributed onto the bearing face 15 and distributes evenly to the sliding faces between the piston 14 and the side walls 3 and 4, as well as, casing 2. Thereby, a good lubrication of the sliding parts is achieved. The distribution of the lubricating oil simultaneously results in a sealing between the piston 14 and the side walls 3 and 4 and also casing 2. This sealing which is obtained in the simplest manner in the operating chamber permits and assures the output of the pump even at low speeds. The excessive lubricating oil is pumped back from the operating chambers through the discharge conduit 18 into the lubricating oil return conduit 22. For this purpose, the discharge conduit 18 is disposed obliquely downwardly from the recess 19.

The invention is not limited to the depicted embodiment. The inventive device for lubrication may be used in its principle for a rotary piston air pump which is used for generating compressed air.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A device for lubricating a rotary piston air pump supported and driven by an engine having a housing penetrated by at least one oil return conduit, said pump comprising; a stationary axel connected to said housing and having an eccentric with a peripheral surface, a rotary casing rotatably mounted on said axle and accommodating a rotor rotatably mounted on the peripheral surface of said eccentric, said casing and rotor together defining variable volume working chambers, suction and discharge recesses in the peripheral surface of the eccentric, said recesses communicating with suction and discharge conduits within said axle, said axle further comprising an oil supply conduit open to said peripheral surface in a laterally offset position with respect to said recesses, said oil supply conduit continuing in a pipe which has an oil scoop extending into said oil return conduit for catching returning oil and delivering it through the pipe and the oil supply conduit to said peripheral surface.

2. A device according to claim 1 wherein said oil return conduit is substantially vertical and said oil scoop is at a higher level than the discharge opening of the oil supply conduit at said peripheral surface.

3. A device in accordance with any one of the aforegoing claims 1–2, including a support element at which the axle is mounted and which contains the suction conduit and the discharge conduit, the oil conduit being mounted between the suction conduit and the discharge conduit in the support element.

4. A device in accordance with any one of the aforegoing claims 1–4, wherein the rotary piston air pump is exclusively used for generating a vacuum, and the discharge conduit discharges into the oil return conduit.

* * * * *